United States Patent [19]

Stahl et al.

[11] 4,100,539

[45] Jul. 11, 1978

[54] BURGLAR ALARM FOR DOOR KNOB

[75] Inventors: Oliver B. Stahl, Satellite Bch.; Harlund L. Byron, Ocoee, both of Fla.

[73] Assignee: Marine Resources, Inc., Fern Park, Fla.

[21] Appl. No.: 764,401

[22] Filed: Jan. 31, 1977

[51] Int. Cl.[2] ..... G08B 13/08

[52] U.S. Cl. ..... 340/546; 200/61.45 R

[58] Field of Search ..... 340/261, 274, 276, 283; 200/61.39, 61.45, 61.46, 61.52, 61.93

[56] References Cited

U.S. PATENT DOCUMENTS

| | | | |
|---|---|---|---|
| 3,175,207 | 3/1965 | Hewitt, Jr. | 340/274 R |
| 3,327,300 | 6/1967 | Birrenkott | 340/283 |
| 3,725,892 | 4/1973 | Faltico | 340/274 R |

FOREIGN PATENT DOCUMENTS

| | | | |
|---|---|---|---|
| 258,669 | 9/1926 | United Kingdom | 340/261 |

*Primary Examiner*—Donald J. Yusko

*Attorney, Agent, or Firm*—Duckworth, Hobby, Allen & Pettis

[57] ABSTRACT

A burglar alarm apparatus is provided with a housing adapted to slide over a door knob for actuation upon rotation or attempted rotation of the door knob. An insert is provided for insertion into the housing which has a protruding suction cup so that the door knob burglar alarm can be converted for use on windows or sliding glass doors or the like. The burglar alarm has a sensor switch of the platform and ball type, which is resettable and may be turned off by a single switch knob.

13 Claims, 4 Drawing Figures

BURGLAR ALARM FOR DOOR KNOB

BACKGROUND OF THE INVENTION

The present invention relates generally to alarm devices and is more specifically directed to devices that can be temporarily placed on conventional door knobs to act as burglar alarms, but which can be converted to an alarm for a window or sliding glass door, or the like.

Alarm devices for attachment to door knobs for sounding alarms when anyone attempts to enter a door have been suggested in a variety of forms. Typically, these alarms slide over and engage a door knob in a sufficiently secure manner and has to be rotated when the door knob is rotated, thereby actuating a switch such as a mercury switch, located in the burglar alarm housing. Other such alarms may be held to the door knob with a latching or spring-loaded device, or may be bolted to the door knob for actuating a separate alarm. Typical prior art door knob alarms may be seen in U.S. Pat. No. 3,488,651, to Brenner, for a portable alarm which has a bracket which clips over a door knob, and includes a mercury switch, which is actuated by the rotation of the alarm housing. The U.S. Pat. No. 3,725,892, to Faltico, teaches a door knob burglar alarm using mercury switches which has a receptacle in the housing for slipping over the door knob, while the Birrenkott U.S. Pat. No. 3,327,300, provides a door knob burglar alarm for suspension from a door knob which is actuated by an off-center, over balance, when the door knob is turned in either direction. A patent to Fontaine, U.S. Pat. No. 3,623,063, has an alarm which is attached to a door and has a handle which extends up over the door knob and is actuated by a change in the frequency of an oscillator by the rotation of the door knob, while the Seely U.S. Pat. No. 2,791,763, suspends a burglar alarm to a door knob with a switch which incorporates the knob so that rotating the knob shifts the housing and a support for the housing to complete a circuit through the door knob. The Kreuger U.S. Pat. No. 2,640,894, teaches a burglar alarm suspended from a door knob which includes an extension for a close-by window. Other door knob burglar alarms include the Miller U.S. Pat. No. 2,423,610, which includes an extension connection for attaching a suction cup to a nearby window pane or door, and the Fruehauf U.S. Pat. No. 704,247, having an extension attached to the door knob for actuating an alarm circuit, and the Getto U.S. Pat. No. 775,723, for an electric burglar alarm, and the Hausser U.S. Pat. No. 1,534,589, for an electric door knob alarm.

In contrast with these prior door knob burglar alarms, the present invention provides for a door knob alarm which is easily connected to a door and which may be quickly removed and carried along when staying in motels, hotels, and other accomodations when away from home, and which may be quickly converted for use as a window or sliding glass door alarm; and which has a simplified alarm sensor which may be quickly reset or disabled through a single cam-actuated switch.

SUMMARY OF THE INVENTION

A door knob burglar alarm apparatus has a housing with a receptacle formed therein sized to fit over a door knob, which receptacle is partially lined with a resilient material for frictionally engaging the door knob so as to move the housing upon the rotation of the door knob. The alarm housing has an electrical circuit disposed therein which includes batteries connected to an annunciator through a sensor switch which senses the movement of the housing to actuate the annunciator. The sensor switch has a conductive ball switching member, located on a conductive platform adjacent a conductive wall, so that movement of the housing will cause the ball to roll off the platform between the conductive platform and the conductive wall to complete a circuit from the battery to the annunciator for actuating the annunciator. The sensor switch is reset by a "reset and off" knob which rotates a cam to slide a reset platform located around the platform against the ball so that the ball can roll back upon the platform. The reset platform can be locked up to prevent contact between the ball and the conductor walls through the ball. An insert attachment may be shaped like a door knob and may be insertably mounted into the housing receptacle in place of the door knob, and has a suction cup fixedly attached thereto so that the burglar alarm can be attached with a suction cup to a window or sliding glass door to sound an alarm upon the opening or jarring of the window or sliding glass door.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
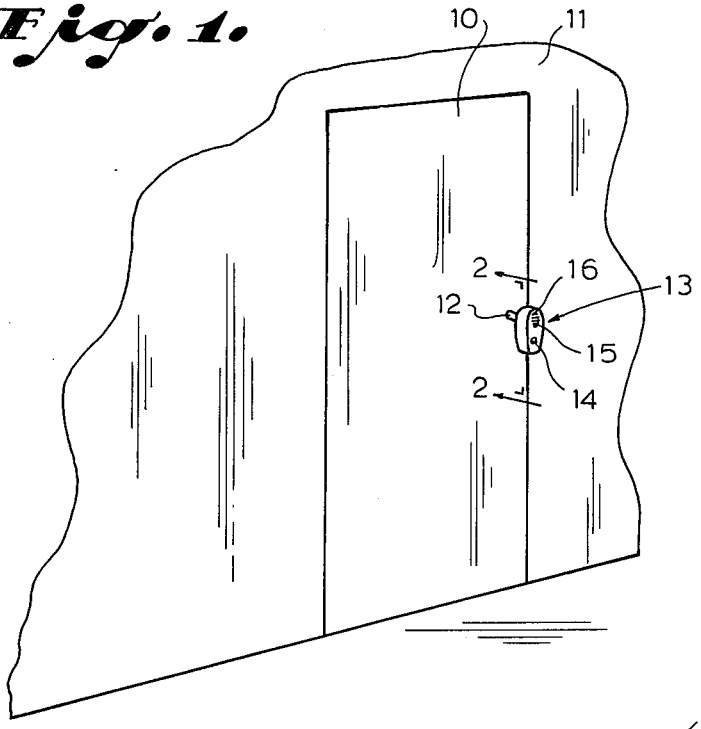
FIG. 1 is a perspective view of a door having an alarm in accordance with the present invention attached thereto.
Figure 2:
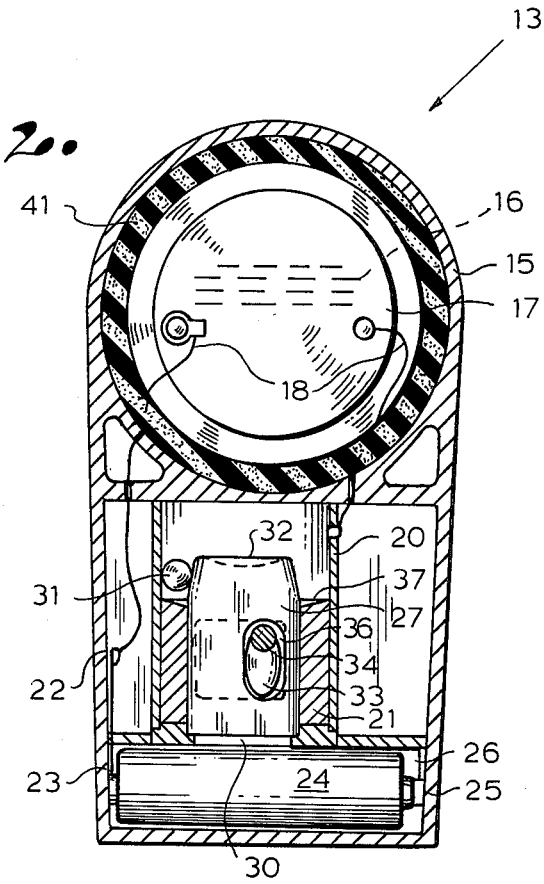
FIG. 2 is a sectional view of the burglar alarm, taken on the line 2—2 of FIG. 1.
Figure 3:
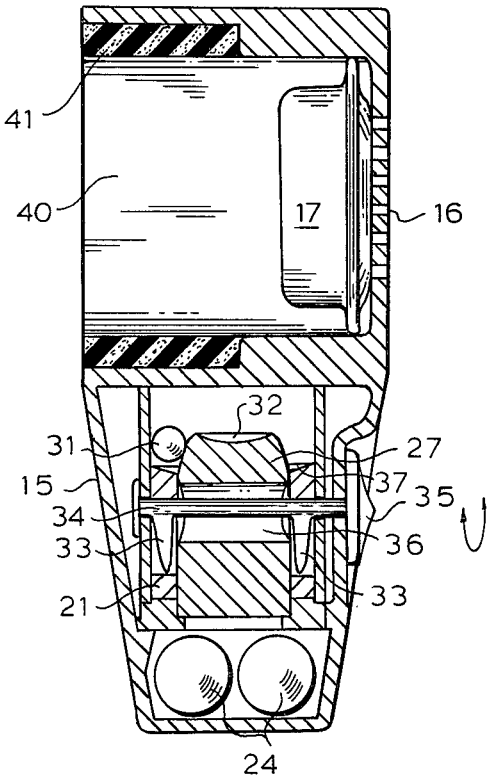
FIG. 3 is a side sectional view of the burglar alarm in accordance with FIG. 2.
Figure 4:
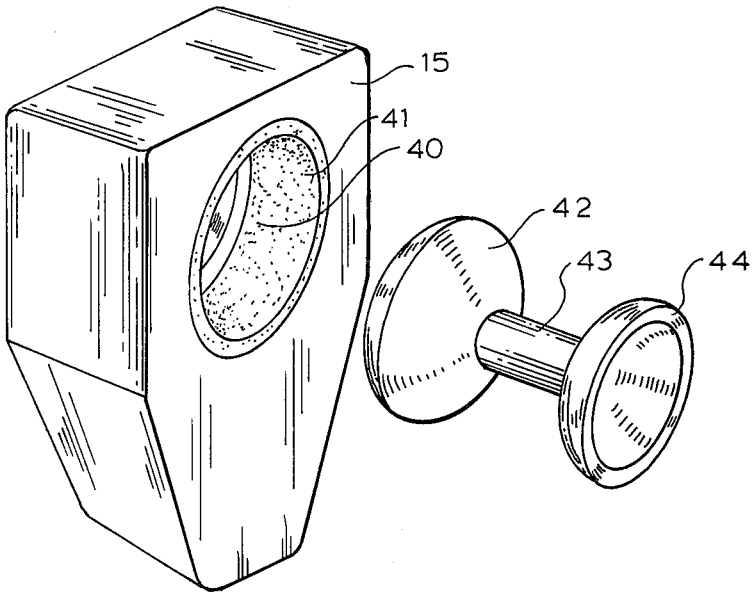
FIG. 4 is a perspective view of an attachment for the burglar alarm of FIGS. 1, 2, and 3, for converting the door knob alarm to a window or sliding glass door alarm.

Referring now to the drawings, FIG. 1 illustrates a door 10 through an exterior or interior wall 11 of a building and having a door knob 12 with a burglar alarm 13 attached thereto which burglar alarm has a switch knob 14 and a housing 15 which housing has a grille opening 16 therein. As more clearly seen in FIG. 2 and 3, the housing 15 has an electrical annunciator 17 which sounds an alarm through the grille 16. The annunciator 17 is connected by a pair of conductor wires 18 to a conductor wall 20 which may be a hollow, cylindrical metal or a metal coated polymer wall. The annunciator is also connected by a wire conductor 22 to a battery contact 23 which, in turn, makes contact with a battery 24, while the opposite pole of the battery makes contact with a battery contact 25 which is connected to an electrical conductor wire 26 which is connected to a support platform 27 supported on a base portion 30 of the battery compartment. A conducting metal sphere 31 normally rides on the conducting metal coated top 32 of the platform 27 until the housing 15 is rotated or jarred, at which time the metal ball 31 can roll off of the top 32 and lodge between the sides of a conducting portion of the platform 27 and the conducting portion of cylindrical wall 20, thereby making contact therebetween and completing the circuit from the annunciator 17 through the conducting wires 18 and the conducting wall 20 through the sphere 31 and through the conducting platform 27 thereby through the conducting wire 26 to the battery contact 25 to complete the circuit and actuate the annunciator 17. It will, of course, be clear the wall 20 and platform 27 can be either made of a solid metal material or can have portions coated with an electrical conductive material without departing from the spirit and scope of the invention. Once the alarm has been actuated, it can be reset by the rotation of a pair of cams 33 mounted to a shaft 34 which, in turn, is connected to a rotating reset knob 35 located on the exterior of the housing 15. Rotation of the knob 35 rotates the shaft 34 and the cams 33 located in the hollow portion 36 of a resetting sleeve 21 to drive the sleeve 21 upward to a position that the sphere 31 can roll back on top of the top 32 of platform 27. When the switch knob 35 is rotated in the opposite direction, the resetting sleeve 21 is lowered by the cam 33. The switch knob 35 can be rotated to lock the cams 33 either up to disable the alarm or down when the alarm is set.

Thus, when the cams 33 are locked in their up position with the reset sleeve 21 up, the sphere 31 cannot make contact between support 27 and wall 20, thereby turning the alarm off and preventing the closing of the circuit when the alarm is being stored or transported. Platform 27 has a passageway therethrough for shaft 34, and sleeve 21 has openings 36 therein as well as angled ledge 37, which assists the sphere 31 in rolling onto the top 32.

A receptacle 40 is partially lined with a resilient plastic foam, or foam rubber 41, and is shaped to engage an average door knob frictionally, with the foam 31 to support the burglar alarm housing 15 on the door knob. However, under certain circumstances, the alarm owner might wish to use the alarm on windows or sliding glass doors in which event, an attachment insert 42 shaped like a standard door knob, to fit the receptacle 40 of the housing 15, which may be of a rigid foam plastic, such as a foamed polystyrene may be inserted in a receptacle 40 of the housing 15. The knob-shaped attachment 42 has a protruding portion 43 with a suction cup 44 fixedly mounted thereto, so that upon the insertion of the ball 42 into a receptacle 40, the entire housing may be attached to a window, sliding glass door, or any other surface with the suction cup 44 to act as an alarm for the window or the sliding glass door, or the like.

The present alarm advantageously may be disconnected with the switch 35 and packed in a bag, or the like, with the attachment 42, and taken on trips for use in motels or the like, on either windows or doors. A simple central switch actuates the alarm whether it is rotated or jolted, or moved in a lateral direction, thereby allowing the alarm to be used on different entryways. It should be clear at this point that a burglar alarm for doorknobs, windows, and the like, has been provided which provides for different types of attachments, but it should also be clear that other variations are contemplated as being within the spirit and scope of the invention, which is not to be construed as limited to the particular forms disclosed herein.

I claims:

1. An alarm appartus comprising in combination:

a housing having a receptacle formed therein, the receptacle being sized to fit over a door knob, or the like, and being at least partially lined with a resilient material disposed for engaging a door knob to permit movement of said housing with the rotation of a door knob that said housing is attached to;

electrical circuit means disposed in said housing and including operatively connected battery means, annunciator means, and switch means, said switch means including an electrical conductor platform, a movable electrical conductor switching member, and an electrical conducting wall, whereby movement of said housing allows said movable electrical conductor switching member to fall from said platform between said platform and conducting wall to complete a circuit and actuate said annunciator; and a reset knob located adjacent said housing for resetting an actuated alarm switch means by sliding a reset member to position said movable electrical conductor switching member upon said conductor platform.

2. The alarm apparatus in accordance with claim 1, in which said housing has a switch housing located therein having a slidable sleeve slidably mounted adjacent said conductor platform therein.

3. The burglar alarm in accordance with claim 2, in which said movable switching member is a generally spherical metal member.

4. The alarm apparatus in accordance with claim 3, in which said electrical conducting wall is cylindrically shaped metal wall.

5. The burglar alarm in accordance with claim 2, in which said reset knob is operatively connected to at least one cam, located adjacent said slidable sleeve for camming said sleeve to lift said movable switching member to allow said movable switching member to roll upon said platform and returning said reset knob will allow said slidable reset sleeve to return to its normal operative position.

6. The apparatus in accordance with claim 5, in which said slidable reset sleeve has an opening therein and at least one said cam is located therein.

7. The apparatus in accordance with claim 6, in which said reset knob can be rotated 180° to lock said cam against said sliding reset sleeve thereby preventing completion of said electrical circuit means.

8. The alarm apparatus in accordance with claim 1, including an insert attachment means for inserting into said housing receptacle for connection to said housing, and having at least one suction cup attached thereto, whereby attaching said insert attachment means to said housing converts a door knob burglar alarm for use on windows or sliding glass doors, or the like.

9. A burglar alarm apparatus comprising in combination:

a housing having a receptacle formed therin, the receptacle being sized to fit over a door knob, or the like, and being at least partially lined with a resilient material disposed for engaging a door knob to allow movement of said housing with the rotation of the door knob that said housing is attached to;

electrical circuit means disposed in said housing including operatively connected battery means, annunciator means, and sensor switch means, said sensor switch means having an electrical conductor platform and a generally spherical shaped movable switching member whereby movement of said housing will allow said spherical switching member to roll from said platform to actuate an annunciator;

an insert attachment means for inserting into said housing receptacle for engagement to said housing, and at least one suction cup attached to said insert attachment means, whereby attaching said insert attachment means to said housing converts a door knob burglar alarm for use on windows, sliding glass doors, and the like; and a reset knob located on said housing for resetting an actuated alarm sensor switch by sliding a slidable reset sleeve surrounding said conductor platform a predetermined distance to allow said movable switching member to roll back onto said platform.

10. The apparatus in accordance with claim 9, in which said reset knob is connected to at least one cam positioned adjacent said slidable reset sleeve for sliding said reset sleeve to a reset position, and for locking said reset sleeve for disengaging said burglar alarm.

11. The apparatus in accordance with claim 9, in which said insert attachment means is a rigid, foamed polymer having a generally door handle shape.

12. The apparatus in accordance with claim 11, in which said insert attchment means has at least one suction cup attached thereto by means of a suction cup support member formed into said insert attachment means.

13. The apparatus in accordance with claim 11, in which said resilient material disposed in said housing receptacle is a foamed, resilient polymer material, at least partially lining said receptacle.

* * * * *